US005722218A

United States Patent [19]

Lerner

[11] Patent Number: 5,722,218

[45] Date of Patent: Mar. 3, 1998

[54] PLASTIC TRANSPORT SYSTEM

[75] Inventor: Hershey Lerner, Aurora, Ohio

[73] Assignee: Automated Packaging Systems, Inc., Streetsboro, Ohio

[21] Appl. No.: 699,128

[22] Filed: Aug. 16, 1996

[51] Int. Cl.[6] ..... B65B 43/26; B65B 43/28; B65B 41/12; B65B 41/14

[52] U.S. Cl. ..... 53/459; 53/468; 53/469; 53/284.7; 53/570; 198/819; 226/109; 226/172; 493/319; 493/338; 493/339

[58] Field of Search ..... 53/468, 469, 459, 53/570, 284.7, 384.1; 226/173, 172, 91, 109; 198/819; 493/338, 339, 318, 319, 309

[56] References Cited

U.S. PATENT DOCUMENTS

| | | | |
|---|---|---|---|
| 2,667,997 | 2/1954 | Vogt | 53/570 X |
| 2,671,587 | 3/1954 | Vogt | 53/284.7 X |
| 2,845,166 | 7/1958 | Schaeffer | 198/819 |
| 3,019,855 | 2/1962 | Engle | 226/173 X |
| 3,120,892 | 2/1964 | Henning et al. | 198/819 X |
| 3,190,049 | 6/1965 | Van Der Meulen | 53/570 X |
| 3,197,936 | 8/1965 | Messmer | 53/570 X |
| 3,323,703 | 6/1967 | Wibbing et al. | 226/173 |
| 3,359,703 | 12/1967 | Quaadgras | 53/562 X |
| 3,427,684 | 2/1969 | Tsien | 226/173 X |
| 3,492,783 | 2/1970 | Dohmeier | 53/570 X |
| 3,540,183 | 11/1970 | Bodolay et al. | 53/455 X |
| 3,559,874 | 2/1971 | Titchenal . | |
| 3,567,095 | 3/1971 | Geist et al. | 226/172 |
| 3,583,127 | 6/1971 | Marchand | 53/570 X |
| 3,610,501 | 10/1971 | Wolfelsperger | 226/172 |
| 3,673,765 | 7/1972 | Dohmeier et al. | 53/570 |
| 3,744,211 | 7/1973 | Titchenal et al. | 53/384.1 X |
| 3,746,056 | 7/1973 | Titchenal et al. | 53/384.1 X |
| 3,773,235 | 11/1973 | Canamero et al. | 226/173 X |
| 3,779,449 | 12/1973 | Membrino . | |
| 3,791,573 | 2/1974 | Titchenal et al. . | |
| 3,817,017 | 6/1974 | Titchenal . | |
| 3,969,746 | 7/1976 | Titchenal et al. | 53/570 |
| 4,169,345 | 10/1979 | Douwenga | 53/570 |
| 4,201,031 | 5/1980 | Wiles . | |
| 4,505,382 | 3/1985 | Mareau | 198/819 |
| 4,514,962 | 5/1985 | Ausnit | 53/384.1 X |
| 4,558,556 | 12/1985 | Jostler | 53/570 X |
| 4,586,319 | 5/1986 | Ausnit . | |
| 4,617,785 | 10/1986 | Chikatani et al. | 53/570 X |
| 4,654,878 | 3/1987 | Lems . | |
| 4,665,552 | 5/1987 | Lems et al. | 53/469 X |
| 4,850,178 | 7/1989 | Ausnit | 53/384.1 X |
| 4,945,714 | 8/1990 | Bodolay et al. | 53/562 X |
| 4,969,310 | 11/1990 | Lerner et al. . | |
| 5,187,917 | 2/1993 | Mykleby . | |
| 5,197,318 | 3/1993 | Joyce et al. | 226/172 X |

OTHER PUBLICATIONS

"Joker System Joker Combi Lin Packaging System", Joker System AB (undated brochure).

*Primary Examiner*—Horace M. Culver
*Attorney, Agent, or Firm*—Watts, Hoffmann, Fisher & Heinke Co., L.P.A.

[57] ABSTRACT

A conveyor system for gripping and transporting plastic film is disclosed in the environment of a packaging machine and process for loading bags of a novel web of side connected bags. The web is fed through a bagger section by a pair of grooved main transport belts and a pair of lip transport belts each disposed in the groove of the associated main belt to trap bag lips in the grooves. Adjustable belt spreaders space reaches of the transport belts as they move through a load station whereby to sequentially open the bags into rectangular configurations. Alternate conveyor embodiments are also disclosed. The belts of each embodiment are constructed such that when force is applied to a gripped plastic film coaction of the film and belts causes the belt gripping of the film to tighten.

51 Claims, 5 Drawing Sheets

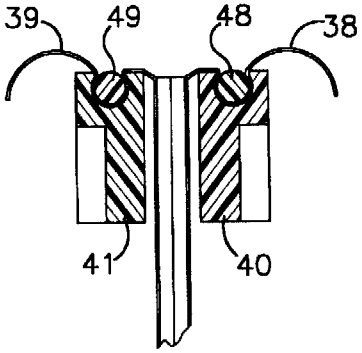
Fig.5
Fig.4
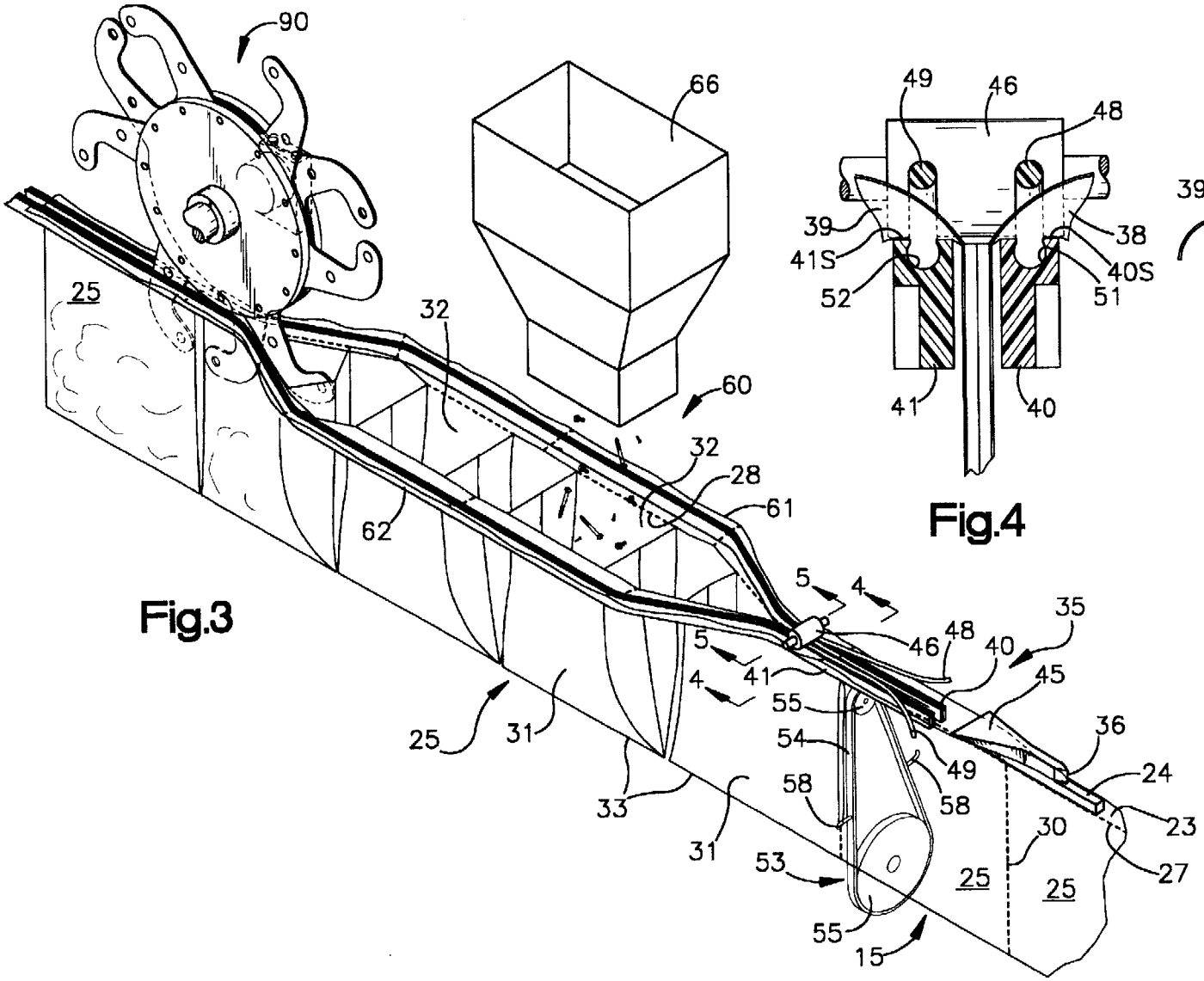
Fig.3

PLASTIC TRANSPORT SYSTEM

This invention relates to a conveyor system for gripping and transporting plastic film and more particularly to a system in which force applied to the film by a work operation results in tighter gripping of the film by the conveyor system.

BACKGROUND OF THE INVENTION

U.S. Pat. No. 4,969,310 issued Nov. 13, 1990 to Hershey Lerner et al. under the title Packaging Machine and Method and assigned to the assignee of this patent (the SP Patent) discloses and claims a packaging machine which has enjoyed commercial success. One of the major advantages, of the machine of the SP Patent resides in a novel conveyor belt mechanism for gripping upstanding lips of bags of a chain as they are transported along a path of travel and registered at a load station. The firmness with which the lips are gripped makes the machine highly suitable for packaging bulky products which are stuffed into the bags.

While the machine of the SP Patent was an advance over the prior art, especially in terms of its lip gripping capability, even greater lip gripping capabilities, if achieved, would be useful in enabling packaging of additional products and for other purposes. Expressed another way, the bag gripping forces of the machine of the SP Patent are dependent on clamping pressure applied between pairs of belts. Thus, while the machine was a definite advance over the art, as to any given bag size, it has a finite maximum stuffing pressure it can withstand without slippage.

Since the bag gripping of the machine of the SP Patent is dependent on the force with which belt pairs are clamped, the length of the path of travel through the load station is limited. Thus the length of a bag along the path of travel is limited, loading of a bag while it moves along the path of travel is not possible and the concurrent loading of two or more bags is not available.

Other mechanisms for gripping a plastic film for transport as through a packaging machine or other applications such as stretching film for biaxial orientation have typically also relied on some sort of mechanically applied clamping to provide gripping for film transport. Accordingly, there is a need for an improved plastic transport system embodying enhanced plastic gripping characteristics which does not rely on externally applied clamping forces.

SUMMARY OF THE INVENTION

With the system of the present invention, the described problems of the prior art and others are overcome. An overall machine utilizing the system and many of the machine's features are described and claimed in a concurrently filed application of Hershey Lerner and Dana Liebhart entitled Packaging Machine, Material and Method, Ser. No. 08/699,129 filed Aug. 16, 1996, (herein the New Patent). The New Patent is incorporated by reference in its entirety.

Thus, one application utilizing the outstanding advantages of the present invention resides in a novel and improved mechanism for gripping upstanding lips of bags as they are transported through a load section. Gripping is achieved by coaction of the bags upstanding lips and unique belts alone such that belt clamping mechanisms are neither required nor relied on. To this end a pair of main transport belts are provided and positioned on opposite sides of a path of web travel. In the preferred embodiment, each main belt has an upstanding lip contacting surface with a centrally located, transversely speaking, lip receiving recess preferably of arcuate cross-sectional configuration. A pair of lip transport belts of circular cross-section are respectively cammed into the main transport belt recesses to force bag lips into the recesses and in so doing to reeve the lips around associated transport belts. Once the novel belts are cammed together, the lips are fixed between the belts with a holding power far in excess of that achieved with the prior art.

Alternate belt configurations are also disclosed. A characteristic of most if not all of the disclosed embodiments is that when forces are applied to transported plastic film by a work operation, such as when bags are loaded, the greater the force applied in effecting the loading or other operation, the greater the resistance to fill slippage relative to the belts.

With each of the alternate embodiments a coacting transport mechanism is provided. The mechanism in each case includes at least one belt of circular cross section. Plastic film to be transported for a work operation is reeved at least partially around that one belt. A coacting member usually in the form of a second belt, but in two disclosed embodiments a rail, includes an elongate recess in which the circular belt is at least partially disposed. In each case as forces are applied to a gripped film tending to pull the film from the belt, those forces tend to pull the round the belt against walls defining at least part of the recess. This action increases the grip of the film trapped between the belt and the walls. The greater the force applied to the fill, the greater the force urging the belt against the walls and the film trapped between them. As a result, frictional gripping of the film is increased proportionally to the force applied to the film.

Since the gripping of plastic fill for support is accomplished through coaction of the fill and the conveyor belts, there is essentially no limit to the length of a transport path for a work operation. Thus, with the machine of the New Patent there is essentially no limit to the length of the loading station and an enhanced range of available packaging sizes is achieved. Multiple numbers of open bags can be concurrently conveyed through the loading station. With a machine operating on a continuous basis and a synchronized product supply conveyor adjacent the load station, one is able concurrently to transfer a set of products into a like numbered set of bags with the transfer progressing concurrently as the bags and the conveyed products advance through the load station.

Another advantage of an elongated load station is that one may position a series of vibrator feeders along the station. As an example, a first vibratory feeder could deposit a desired number of bolts in a bag at a first location, a second feeder a like number of washers at a second location downstream from the first, and a third feeder a like number of nuts at a third location still further downstream; thus, eliminating the need for a part supply conveyor.

With this arrangement extremely high rates of packaging can be achieved. For example, it is possible to load and seal 130 ten inch bags per minute. Rates achieved with the present machine are rates in excess of those that can be achieved with virtually all, if not all, prior art machines including so called "form and fill" machines.

Accordingly, the objects of this invention are to provide novel and improved film gripping and transport system utilizing novel and improved web gripping belts and methods of gripping and transporting plastic film.

IN THE DRAWINGS

FIG. 3 is a perspective view showing sections of the preferred transport belts transporting a web through the load station;

Figure 1:
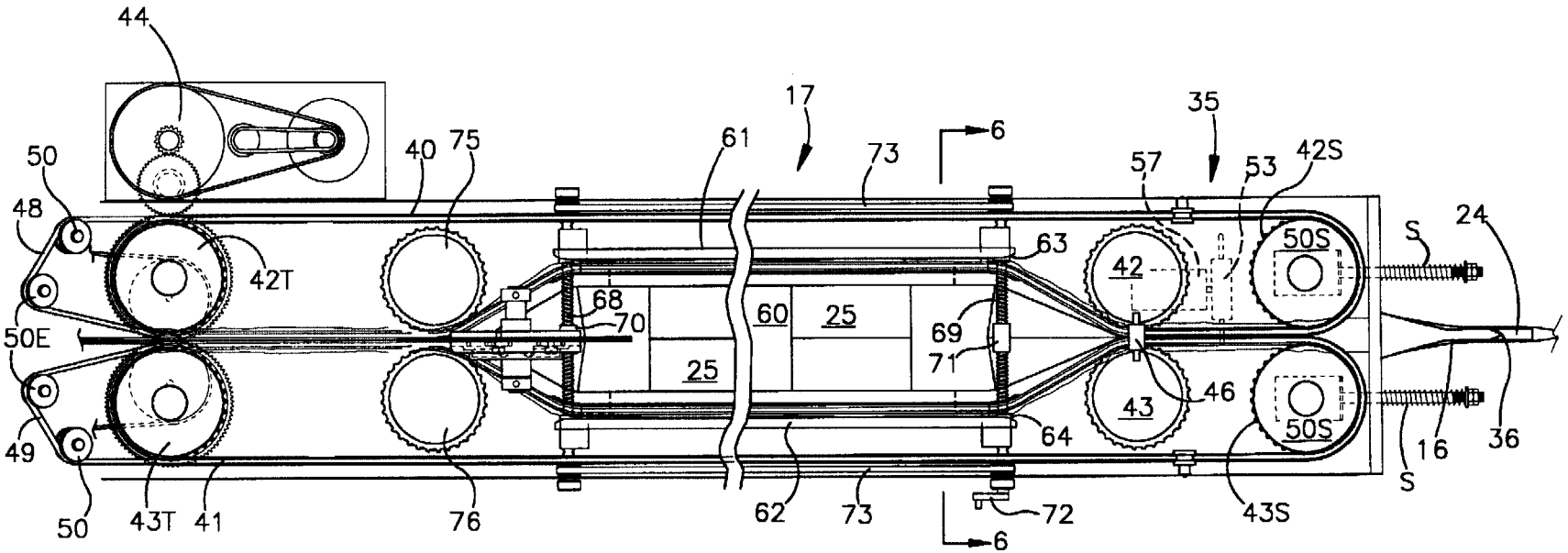
FIG. 1 is a fragmentary top plan view of a bagger section of a machine utilizing the preferred film gripping system of this invention.
Figure 6:
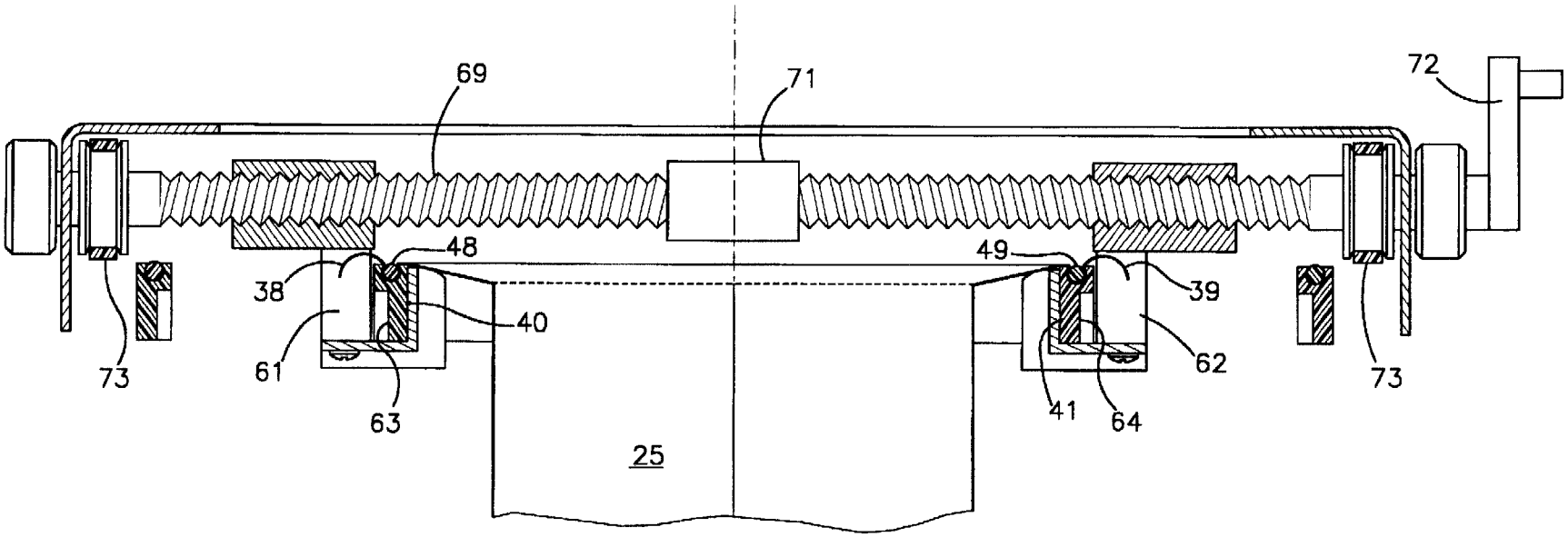

FIGS. 4 and 5 are enlarged sectional views from the planes respectively indicated by the lines 4—4 and 5—5 of FIG. 3 show the preferred main and lip transport belts together with a fragmentary top portion of the bag as bag lips are folded over the main transport belts and then trapped in the grooves of the main belts;

FIG. 6 is an enlarged, fragmentary, sectional view of the transport belt spacing adjustment mechanism as seen from the plane indicated by the lines 1—1 of FIG. 1; and, FIGS. 7–14 are sectional views of alternate belt embodiments each as seen from a plane normal to a path of travel of plastic film supported by the belts.

DETAILED DESCRIPTION OF THE PREFERRED EMBODIMENT

I. The Machine of the New Patent

Figure 2:
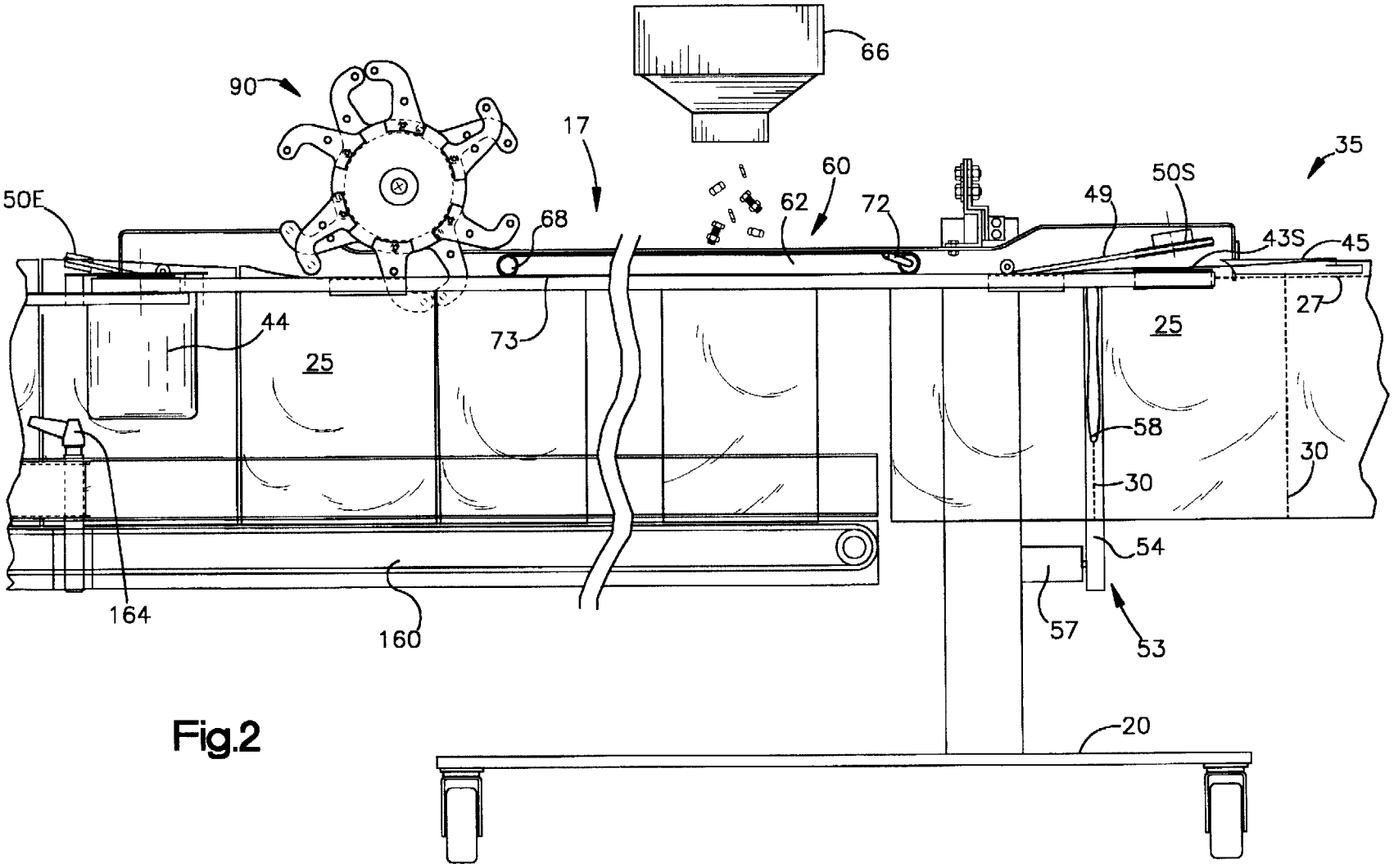
FIG. 2 is a foreshortened elevational view of the bagger section as seen from the plane indicated by the line 2—2 of FIG. 1.

Referring to FIGS. 1, 2 and 3 a web 15 of side connected bags is provided. The web 15 is fed from a supply shown schematically at 16 to a bagger section 17. The bagger section 17 is separably connected to a bag closure section (not shown). The bagger section includes a wheeled support carriage 20. The support carriage 20 includes a support frame for supporting bagging mechanisms.

In the drawings the bagging mechanism is shown in its vertical orientation for gravity loading. The machine will be described in such orientation it being recognized that the mechanism may be positioned in a horizontal orientation and at other angular orientations.

II. The Web 15

The web 15 is an elongated flattened plastic robe, typically formed of polyethylene film. The robe includes a top section 23 for feeding along a mandrel 24, FIG. 3. The top section 23 is connected to the tops of a chain of side connected bags 25 by front and back lines of weakness in the form of perforations 27, 28. Frangible connections 30 connect, adjacent bag side edges, FIGS. 2 and 3. Each bag 25 includes a face 31 and a back 32 interconnected at a bottom 33 by a selected one of a fold or a seal. Side seals adjacent the interconnections 30 delineate the sides of the bags 25. The bag faces and backs 31, 32 are respectively connected to the top section 23 by the lines of weakness 27, 28, such that the top section 23 when the web is flattened itself is essentially a tube.

III. The Bagger Section 17

A. A Bag Feed and Preparation Portion 35

The web 15 is fed from the supply 16 into a bag feed and preparation portion 35 of the bagger section 17. The feed is over the mandrel 24 and past a slitter 36, FIG. 3. The slitter 36 separates the top section 23 into opposed face and back lips 38, 39. The feed through the bag feed and preparation portion 35 is caused by a pair of endless, oppositely rotating, main transport belts 40, 41 supported by oppositely rotating pulley sets 42, 43. The main belts 40, 41 are driven by a stepper motor 44, FIG. 3 through toothed pulleys 42T, 43T of the sets 42, 43. Other of the pulleys 42S, 43S are spring biased by springs S, FIG. 1, to tension the belts.

A plow 45 is provided and shown in FIGS. 2 and 3. For clarity of illustration the slitter and the plow have been omitted from FIG. 1. The plow is positioned a short distance upstream from a roller cam 46. As the lips are drawn along by the main transport belts 40, 41, the lips 38, 39 are respectively folded over the top bag engaging surfaces 40S, 41S, of the main transport belts under the action of the plow 45 as depicted in FIG. 5.

Once the lips are folded over the tops of the main transport belts 40, 41, the roller cam 46 presses endless, lip transport and damp belts 48, 49 into complemental grooves 51, 52 in the main transport belts 41, 42 respectively. Thus, the grooves 51, 52 function as bag damping surfaces that are complemental with the damping belts 48, 49. More specifically, the clamp belts are circular in cross section, while the grooves 51, 52 are segments of circles, slightly more than 180° in extent. The camming of the damp belts into the grooves traps the lips 38, 39 between the damp belts and the grooves. The lip damping firmly secures the lips between the coacting belt pairs such that the lips, due to their coaction with the belts, are capable of resisting substantial stuffing forces as products are forced into the bags at a load station 60. Sections of the clamp belts which are not in the grooves 51, 52 are trained around a set of lip transport belt pulleys 50.

A bag side separator mechanism 53 is provided at a bag connection breaking station. The separator mechanism 53 includes an endless belt 54 which is trained around a pair of spaced pulleys 55 to provide spans which, as shown in FIGS. 2 and 3, are vertical. The pulleys 55 are driven by a motor 57, FIG. 2. As the belt is driven breaking pins 58 projecting from the belt 54 pass between adjacent sides of bags to break the frangible interconnections 30. Thus, as the bags depart the bag feed and preparation portion 35, they are separated from one another but remain connected to the lips 38, 39.

B. The Load Station 60

The load station 60 includes a pair of parallel belt spreaders 61, 62. The belt spreaders are mirror images of one another. As is best seen in FIG. 6, the belt spreaders respectively include channels 63, 64. The channels 63, 64 respectively guide the main transport belts 40,41, on either side of the load station 60. When the transport belts 40,41, are in the channels 63, 64, as is clearly seen in FIGS. 3 and 6, the bags 25 are stretched between the belts in a rectangular top opening configuration.

A schematic showing of a supply funnel 66 is included in FIG. 3. As suggested by that figure, the products to be packaged are deposited through the rectangular bag openings each time a bag is registered with the supply funnel at the load station.

A space adjusting mechanism is provided. This mechanism includes a spaced pair of adjustment screws 68, 69, FIG. 1. The adjustment screw 68, 69 are respectively centrally journaled by bearings 70, 71. The screws have oppositely threaded sections on either side of their bearings 70, 71 which threadably engage the belt spreaders 61, 62. Rotation of a crank 72 causes rotation of the adjustment screw 69. The screw 69 is connected to the screw 68 via belts or chains 73, which function to transmit rotation forces so that when the crank 72 is operated the screws 68, 69 are moved equally to drive the spreaders equally into an adjusted spatial, but still parallel, relationship.

As the spreaders are movably adjusted toward and away from one another, the spring biased pulleys 42S, 43S maintain tension on the main transport belts 40, 41 while permitting relative movement of spans of the belts passing through the spreader channels 63, 64. Similarly, spring biased lip transport belt pulleys 50S maintain tension on the damp belts 48, 49. The spring biased pulleys of both sets are the pulleys to the right as seen in FIG. 1, i.e. the entrance end pulleys in the bag feed and preparation portion 35.

The main transport pulley sets 42, 43 include two idler pulleys 75, 76 downstream from the load station 60. The idler pulleys 75, 76 are relatively closely spaced to return the main transport belts 40, 41 into substantially juxtaposed relationship following exit from the load station 60.

Since the main and lip transport belts are relatively flexed in a vertical plane as they are brought together to grip a bag and relatively flexed in a horizontal plane as they pass through the load station, it will be seen that the belts are flexible in two directions which are orthoganal to one another.

C. Bag Stretching

As loaded bags exit the load station, it is desirable to return upper portions of the bag faces and backs into juxtaposition. To facilitate this return with smaller bags a novel and improved planetary stretcher 90 is provided. This planetary bag stretcher is more fully described in the New Patent.

IV. A Support Conveyor

While there normally is no need for bottom support of the bags 25 as they pass through the bagger section 17, nonetheless a conventional support conveyor 160 may be provided, see FIG. 2. More frequently a conveyor will be provided under the closure section as disclosed in the New Patent. In either event, suitable height adjustment and locking mechanisms 164 are provided to locate the conveyor 160 in an appropriate position to support the weight of loaded bags being processed into packages.

V. The Alternate Belt Embodiments

Figure 7:
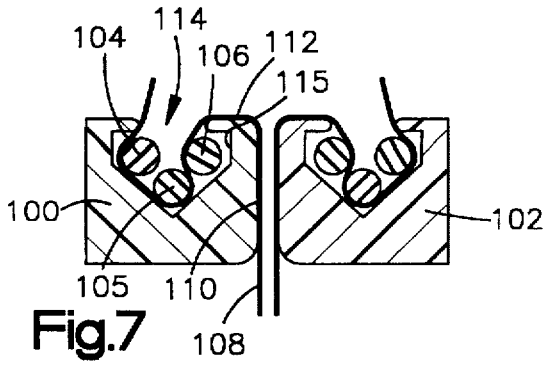

Referring now to FIG. 7, mirror image main transport belts 100,102 are provided. Since the two are mirror images of one another, the transport belt 100 and the elements which coact with it will be described, it being recognized that corresponding mirror image coaction is provided with the belt 102. In this embodiment three lip clamping belts 104–106 are provided. A section of plastic film 108 passes upwardly in engagement with a transport path side 110 of the main transport belt 100. The section 108 then passes across a top section 112 of the transport belt 100 and into a recess 114. The lip clamping belts 104–106 are disposed in the recess 114 which is in the shape of an arrowhead in cross section to accommodate the three belts. The film 108 is reeved over an inside surface of the damping belt 106 and thence under the transport belts 104,105. If downward force is applied to the fill 108, the film tends to push the clamping belt 106 into a corner 115 of the recess 114. The belts 104,105 are pulled together with the belt 105 clamping the film against the belt 106 to increase the gripping power of the arrangement as force is applied to the film 108.

Figure 8:
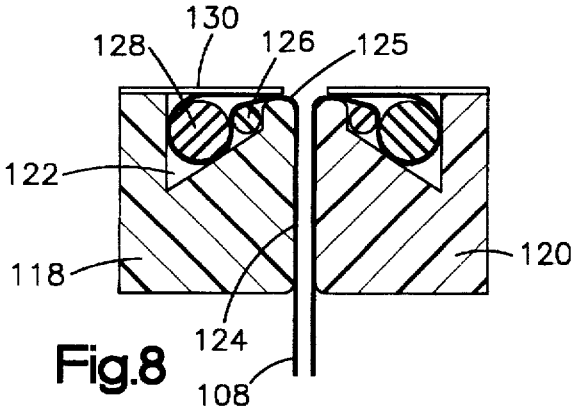

Referring now to FIG. 8, main transport belts 118,120 are disclosed. Again, in that the belts are mirror images, only the left hand belt will be described in detail. The belt 118 includes a generally triangular upper recess 122. The film section 108 extends upwardly along a side 124 of the belt 108, thence over a top surface 125 and into the recess 122. The film rides over a relatively small diameter clamping belt 126 and thence is reeved almost completely around a relatively large clamp belt 128. In this embodiment, the transport belt 118 rides under a rail 130 which retains the clamp belts 126,128 and the film in the recess 122. Downward forces on the film 108 pull the large clamp belt 128 against the rail and the small clamp belt 126 forcing the clamp belt 126 against a corner of the recess 122 and gripping the plastic firmly both between the clamp belts and between the clamp belt 128 and the rail 130.

Figure 9:
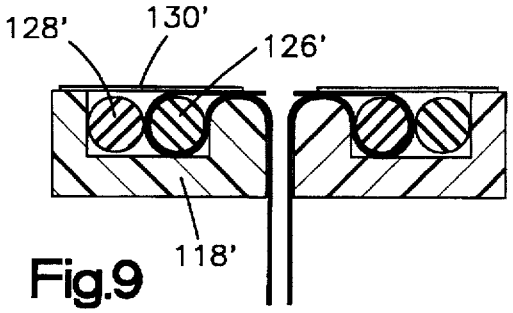

The embodiment of FIG. 9 is similar to FIG. 8, except that the recess is generally rectangular and the clamp belts are of equal size. Accordingly, like reference numerals with primes added are used in that embodiment.

Figure 10:
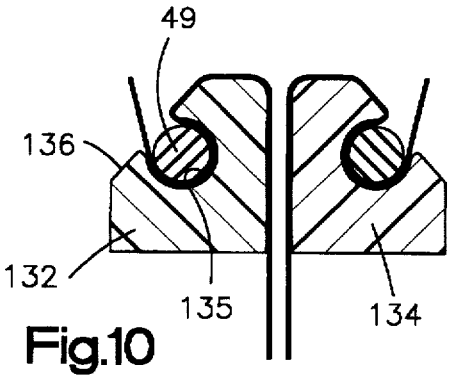

Referring now to FIG. 10, main transport belts 132,134 are provided. These belts are very similar to the preferred belts as shown in particular in FIGS. 5 and 6 with the exception that the clamp belt 49 resides in a recess 135 that is formed in a chamfered outwardly oriented surface 136, rather than a top surface as is the case with the surfaces 40S,41S.

Figure 11:
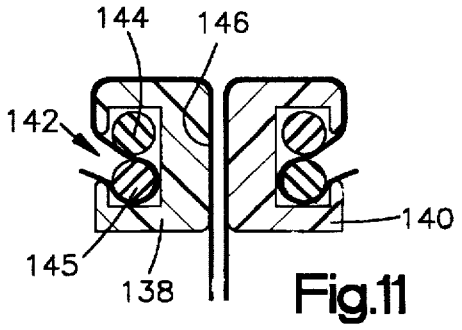

Referring now to FIG. 11, main transport belts 138,140 are provided. The transport belt 138 has an outwardly oriented recess 142 in which upper and lower clamp belts 144,145 are disposed. The film section 108 is trained upwardly along the inwardly facing side of the belt 138 over its top and thence downwardly and into the recess 142. The film is reeved substantially completely around the lower belt 145, such that when tension force is applied to the film 108 the belt 145 is pulled upwardly to increase the damping force between the clamping belts 144,145.

Figure 12:
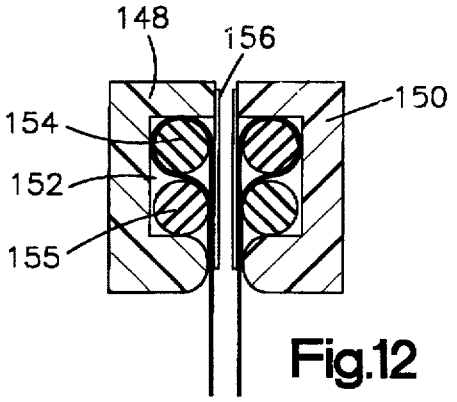

In FIG. 12, stationary rails 148,150 are provided. The rail 148 has in inwardly oriented rectangular recess 152. A pair of equally sized circular clamping belts 154,155 are disposed within the recess 152. The film section 108 is reeved substantially completely around the upper one of the clamping belts 154 and over the lower clamping belt 155, such that downward force on the film 108 will increase friction around a majority of the perimeter of the upper belt 154 and tightly clamp the film between the clamping belts 154,155. Another fixed rail 156 coacts with the belts 154,155 to maintain them in the recess 152.

Figure 13:
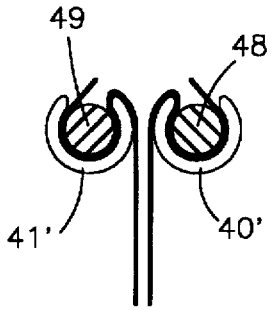

FIG. 13 differs from the preferred embodiment of FIGS. 4 and 5 only in that the external surfaces of the transport belts are circular and thus the belts are identified by their reference numerals 40',41'.

Figure 14:
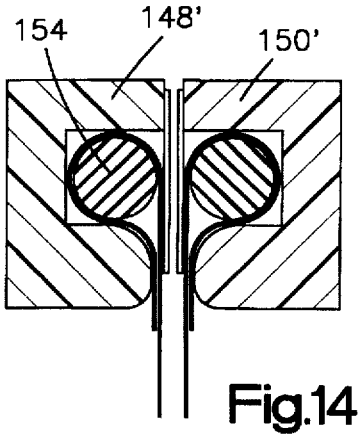

FIG. 14 is a variant of the embodiment of FIG. 12, in which the lower clamping belt 155 has been omitted and stationary rails are identified by the reference numerals 148',150'.

VI. Operation of the Machine

A web 15 of bags 25 is fed through the bagger by jogging. The transverse spacing of the main conveyor belts 40, 41 is adjusted by rotating the crank 72 until the load station 60 has the desired transverse dimension. A control, not shown, is set to provide a desired feed rate and a selected one of continuous or intermittent operation. Assuming continuous operation, the feed rate may be as high as 130 ten inch bags per minute.

Once the machine is in operation, the top section 23 of the web 15 is fed along the mandrel 24 and slit by the slitter 36. This forms the lips 38, 39 which are folded over the main transport belts 40, 41 by the action of the plow 45. The lip damp belts 48, 49 descend from the elevated and spring biased pulleys 50S, as shown in FIG. 3. The roller cam 46 cams the damp belts 48, 49 respectively into the transport belt recesses 51, 52 to provide very positive and firm support for the bags as they are further processed. As successive side connections 30 of the bags are registered with the bag side separator 53, the motor 55 is operated to drive the belt 54 and cause the breaker pins 58 to rupture the side connections 30.

As adjacent runs of the transport belts 40, 41 progress downstream from the bag feed and preparation portion 35, the belts are spread under the action of the belt spreaders 61, 62. As the belts are spread, the lips 38, 39 cause the front and back faces 31, 32 adjacent the lead edge of each bag to separate from the lips 38, 39 by tearing a sufficient length of the perforations between them to allow the lead edge to become the mid point in a bag span between the belts as the bag passes longitudinally through the load station 60. Similarly, the perforations adjacent the trailing edge are torn as the trailing part of the bag is spread until the bag achieves a full rectangular opening as shown in FIG. 3 in particular.

Next a product is inserted into the rectangular bag as indicated schematically in FIGS. 2 and 3. While the schematic showing is of discrete fasteners, it should be recognized that this machine and system are well suited to packaging liquids and bulky products which must be stuffed into a bag, such as pantyhose and rectangular items, such as household sponges.

After the product has been inserted, the adjacent runs of the main transport belts are brought back together and the loaded bag tops are spread longitudinally of the path of travel either by the planetary stretcher 90 or by opposed air streams from nozzles as taught in the New Patent.

As is best seen in FIG. 2, exit ones 50E of the lip belt pulley set are spaced from the main transport belt and rotatable about angular axes. Expressed more accurately, when the machine is in a vertical loading orientation, the pulleys 50E are above the main transport belt such that the lip transport belts are pulled from the grooves 51, 52.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A method of supporting a plastic film for transport and performing a work operation, the method comprising:

a) bringing first and second film sections respectively into engagement with a side part of a surface of an associated one of a spaced pair of first conveyor belts;

b) folding the sections over the respective first belts to bring another part of each section into engagement with another part of its associated first belt;

c) positioning a still further part of each section between its associated first belt and an associated one of a pair of second belts to produce frictional gripping of the sections due to coaction of the belts and sections; and, d) applying a force to at least one of the sections to pull the one section against the associated belts and resisting such force with a gripping resistance produced by coaction of the one section and its associated belts alone.

2. The method of claim 1 wherein each of the first belts includes a recess and wherein the force application step causes the still further part of said one section to be gripped in the recess of the associated first belt.

3. The method of claim 1 wherein the side parts are side surfaces facing one another on opposite sides of a path of travel and wherein the another parts are top surfaces.

4. The method of claim 3 wherein the another parts each include a recess and the positioning step includes camming the belts of the second pair respectively into the recesses.

5. The method of claim 1 wherein the side parts are side surfaces wherein the another parts are side surfaces opposite the side parts of their respective belts.

6. The method of claim 5 wherein the another parts include a recess and the positioning step includes camming the belts of the second pair respectively into the recesses.

7. An improved plastic film gripping system comprising:

a) first and second pairs of conveyor belts positioned on opposite sides of a film transport path of travel the belts being flexible in orthoganal directions;

b) one belt of each pair including an elongate recess;

c) film diverter means for diverting film sections moving along the path respectively into engagement with the one belts; and, d) belt camming means positioned along the path downstream from the diverter means for forcing the other belt of each pair into the recess of its paired said one belt and thereby trap said film sections respectively between belts of the pairs.

8. The machine of claim 7 wherein each of the recesses is in a belt surface generally transverse to the path.

9. The machine of claim 7 wherein each of the recesses is in a belt surface generally parallel to the path.

10. In a machine for transporting a plastic film for a work operation an improved film gripping system comprising:

a) a first endless conveyor belt having an endless film engaging surface;

b) the first belt also having an endless film engaging recess adjacent the surface;

c) a coacting, second endless belt the second belt also having an endless bag engaging surface, the belts being flexible in orthoganal directions; and, d) the recess and the second belt having complemental cross sectional configurations such that film gripping and supporting relationship is established when the second belt is in the recess with a section of film trapped between the second belt and surfaces defining the recess.

11. The machine of claim 10 wherein at least one of the belts is circular in cross section.

12. A method of supporting and transporting plastic film for a work operation comprising:

a) extending each of a pair of film sections to project in a direction away from a film path of travel;

b) bringing each of the film sections into engagement with a segment of a surface of each belt of an associated one of two spaced sets of coacting transport belts; and, c) establishing at least a partial wrap around, self gripping longitudinally continuous relationship between each section and at least one belt of the associated set such that a coacting section gripping relationship is established between each section and its associated belt set whereby substantially to prevent movement of each section transverse to a path of belt movement, the prevented movement being in a direction toward a work operation applying forces to the film.

13. The method of claim 12 wherein the work operation is a film stretching operation.

14. The method of claim 12 wherein the sections are bag lips and the work operation is bag loading.

15. A method of supporting a bag in an open condition for filling an interior volume of the bag, the method comprising:

a) bringing first parts of front and back lips of a bag respectively into engagement with a side part of a surface of an associated one of a spaced pair of first conveyor belts;

b) folding the lips over the respective first belts to bring another part of each lip into engagement with another part of its associated first belt, the another parts being spaced further from the bag volume than the first parts;

c) reeving a still further part of each lip around an associated one of a second pair of belts, the still further parts being respectively spaced further from the volume than said another parts of their respective lips;

d) applying a loading force to the bag to pull the lips against the respective belts and thereby pull the second belts toward the first belts and grip the still further parts between their respective associated belts and resist such loading force with a gripping resistance that increases as the loading force increases.

16. The method of claim 15 wherein each of the first belts includes a recess and wherein the loading force application step causes the still further parts to be gripped in the recess.

17. The method of claim 15 wherein when the bag is suspended vertically, the side parts are generally vertical surfaces facing one another on opposite sides of a path of bag travel and wherein the another parts are top surfaces.

18. The method of claim 17 wherein the another parts each include a recess and the reeving step includes camming the belts of the second pair respectively into the recesses.

19. The method of claim 15 wherein when the bag is suspended vertically, the side parts are generally vertical surfaces facing one another on opposite sides of the path and wherein the another parts are side surfaces opposite the facing surfaces.

20. The method of claim 19 wherein the another parts include a recess and the reeving step includes camming the belts of the second pair respectively into the recesses.

21. In a packaging machine for opening and loading bags sequentially to form packages an improved bag transport system comprising:

a) first and second pairs of conveyor belts positioned on opposite sides of a bag path of travel to and through a loading station, the belts being flexible in orthoganal directions;

b) one belt of each pair including an elongate recess;

c) bag lip diverter means for oppositely diverting lips of bags moving along the path respectively into engagement with the one belts; and, d) belt camming means positioned along the path downstream from the diverter means for forcing the other belt of each pair into the recess of its paired said one belt and thereby trap bag lips respectively between belts of the pairs and thereby resist bag loading forces applied to such bags transversely of the path.

22. The machine of claim 21 wherein each of the recesses is in a belt surface generally transverse to the path.

23. The machine of claim 21 wherein each of the recesses is in a belt surface generally parallel to the path.

24. In a packaging machine for packaging products in bags of a web of preformed and interconnected bags, an improved pair of conveyor belts comprising:

a) an endless main conveyor belt having a pair of endless bag engaging surfaces;

b) the main belt also having an endless bag damping recess interposed between and interconnecting the surfaces;

c) a coacting, endless clamping belt, the belts being flexible in orthoganal directions; and, d) the recess and the coacting belt having complemental cross sectional configuration such that the clamping belt may be forced into the recess in a bag clamping interfitting relationship.

25. The machine of claim 24 wherein the damping belt is circular in cross section.

26. The machine of claim 25 wherein the main belt groove is a segment of a circle in cross section, the segment having an extent greater than 180°.

27. A process of manipulating a chain of side connected bags in preparation for loading and closure to form packages, the process comprising:

a) successively gripping the bags between a pair of main transport belts with upstanding from and back lips of the bags projecting in one direction from the belts and bodies of the bags projecting from the belts in an opposite direction;

b) oppositely folding the lips over the main belts; and, c) securing the lips to the main belts by camming portions of each of the folded over lips into an elongate recess in the belt over which it is folded by forcing each of a pair of clamping belts into an associated recess and thereby establish lip holding grips to resist bag loading forces applied to such bags transversely of the path.

28. The process of claim 27 wherein each of the main belt recesses and the associated damping belt have complemental cross-sectional configurations.

29. The process of claim 28 wherein the configurations are at least partially circular.

30. The process of claim 27 further including the step of spreading the main belts apart after the lips have been so secured to form rectangular load openings in the bags.

31. The process of claim 30 further including separating sections of the lips from bag faces and backs adjacent sides of the bags as the rectangular openings are formed.

32. In a packaging machine for packaging products in bags of a web of preformed and interconnected bags, an improved bag supporting arrangement comprising:

a) a first endless conveyor belt having an endless bag engaging surface;

b) the first belt also having an endless bag engaging recess adjacent the surface;

c) a coacting, second endless belt the second belt also having an endless bag engaging surface; and, d) the recess and the second belt having complemental cross sectional configurations such that a continuous bag gripping and supporting relationship is established when the second belt is disposed in the recess for resisting relative movement longitudinally of the bats and transversely of the belts when a loading force is applied to a gripped bag.

33. The machine of claim 32 wherein at least one of the belts is circular in cross section.

34. A method of supporting and opening bags of a chain of side interconnected bags comprising:

a) extending each of a pair of bag lips to project from a load opening of the bag in a direction away from a bag delineated product receiving space;

b) bringing each of the bag lips into longitudinally continuous engagement with a segment of a surface of each belt of an associated one of two spaced sets of coacting transport belts; and, c) establishing at least a partial wrap around relationship between each lip and at least one belt of the associated set such that a coacting lip gripping relationship is established between each lip and its associated belt set whereby substantially to prevent movement when bag loading forces are applied of each lip transverse to a path of belt movement, the prevented movement being in a direction toward said product space.

35. The method of claim 34 wherein steps (a) through (c) are repeated with each successive bag in the chain.

36. A method of performing a work operation utilizing plastic film comprising:

a) reeving a section of plastic film at least partially around a conveyor belt;

b) trapping the film section between the belt and an elongate coacting mechanism to thereby establish a relative movement resisting grip of the film section between the belt and the mechanism;

c) moving at least the belt and the film section along a path of travel;

d) performing a work operation on the film and thereby applying a force on the film tending to pull the section away from the belt and mechanism; and, e) allowing the film applied force to increase the relative movement resistance of the grip whereby as such force applied to the film increases there is a proportional increase in grip resistance to slippage of the section relative to and transversely of the belt.

37. The method of claim 36 wherein the mechanism is a coacting conveyor belt.

38. The method of claim 36 wherein the belt and section are moved relative to the mechanism.

39. A method of supporting a plastic film for transport and performing a work operation, the method comprising:

a) bringing first and second film sections respectively into engagement with a side part of a surface of an associated one of a spaced pair of first conveyor belts;

b) folding the sections over the respective first belts to bring another part of each section into engagement with another part of its associated first belt;

c) reeving a still further part of each section around an associated one of a pair of second belts;

d) applying a loading force to at least one of the sections to pull the one section against the associated belts and thereby pull the associated second belt toward the first belt and grip the still further part of said one section between the associated belts and resist such force with a gripping resistance that increases as the force increases.

40. The method of claim 39 wherein each of the first belts includes a recess and wherein the force application step causes the still further part of said one section to be gripped in the recess of the associated first belt.

41. The method of claim 39 wherein the side parts are side surfaces facing one another on opposite sides of a path of travel and wherein the another parts are top surfaces.

42. The method of claim 41 wherein the another parts each include a recess and the reeving step includes camming the belts of the second pair respectively into the recesses.

43. The method of claim 39 wherein the side parts are side surfaces wherein the another parts are side surfaces opposite the side parts of their respective belts.

44. The method of claim 43 wherein the another parts include a recess and the reeving step includes camming the belts of the second pair respectively into the recesses.

45. A method of performing a work operation utilizing plastic film comprising:

a) reeving a section of plastic film at least partially around a conveyor belt;

b) trapping the film section between the belt and an elongate coacting mechanism to thereby establish a transverse and longitudinal relative movement resisting grip of the film section between the belt and the mechanism;

c) moving at least the belt and the film section along a path of travel;

d) performing a work operation on the film and thereby applying a force on the film tending to pull the section away from the belt and mechanism; and, e) resisting the film applied force to inhibit slippage of the section relative to and transversely of the belt through coaction of the film, the belt and the mechanism alone.

46. The method of claim 45 wherein the mechanism is a coacting conveyor belt.

47. The method of claim 45 wherein the belt and section are moved relative to the mechanism.

48. In a packaging machine for packaging products in bags of a web of preformed and interconnected bags, an improved pair of conveyor belts comprising:

a) an endless main conveyor belt having a pair of endless bag engaging surfaces;

b) the main belt also having an endless bag damping recess interposed between and interconnecting the surfaces, the groove being a segment of a circle in cross section of an extent greater than 180°;

c) a coacting circular in cross section, endless clamping belt; and, d) the recess and the coacting belt having complemental cross sectional configuration such that the clamping belt may be forced into the recess in a bag clamping interfitting relationship.

49. The system of claim 7 wherein the recess and the other belt are each circular in cross section of a circumferential extent greater than 180°.

50. The machine of claim 10 wherein the recess and the second belt are each circular in cross section of a circumferential extent greater than 180°.

51. The machine of claim 32 wherein each recess and said second belts are each circular in cross section of a circumferential extent greater than 180°.

* * * * *